US008845309B2

(12) United States Patent
Cai et al.

(10) Patent No.: US 8,845,309 B2
(45) Date of Patent: Sep. 30, 2014

(54) VIBRATION REDUCING DEVICE FOR PUMP COVER BODY OF WATER SHUT-OFF DIAPHRAGM PUMP

(76) Inventors: Ying Lin Cai, Guangdong (CN); Chao Fou Hsu, Kaohsiung (TW)

( * ) Notice: Subject to any disclaimer, the term of this patent is extended or adjusted under 35 U.S.C. 154(b) by 666 days.

(21) Appl. No.: 13/067,980

(22) Filed: Jul. 13, 2011

(65) Prior Publication Data

US 2012/0097274 A1 Apr. 26, 2012

(30) Foreign Application Priority Data

Oct. 26, 2010 (TW) ..... 99136652 A

(51) Int. Cl.

| | |
|---|---|
| ***F04B 43/02*** | (2006.01) |
| ***F04B 53/10*** | (2006.01) |
| ***F16K 31/365*** | (2006.01) |
| ***F04B 53/16*** | (2006.01) |
| ***F04B 53/00*** | (2006.01) |

(52) U.S. Cl.

CPC ..... *F04B 43/026* (2013.01); *F04B 53/16* (2013.01); *F04B 53/002* (2013.01)

USPC ..... 417/441; 417/270; 137/510

(58) Field of Classification Search

CPC ..... F04B 35/001; F04B 35/002

USPC ..... 417/270, 440, 441, 312; 137/510

See application file for complete search history.

(56) References Cited

U.S. PATENT DOCUMENTS

| | | | | | |
|---|---|---|---|---|---|
| 1,783,646 | A * | 12/1930 | Hajek | 137/510 |
| 3,078,066 | A * | 2/1963 | Moore | 137/510 |
| 3,079,946 | A * | 3/1963 | Rosler | 137/510 |
| 4,537,387 | A * | 8/1985 | Danby et al. | 137/510 |
| 5,520,215 | A * | 5/1996 | Haboush | 137/510 |
| 5,613,834 | A * | 3/1997 | Du | 417/270 |
| 5,791,882 | A | 8/1998 | Stucker et al. | |
| 6,299,414 | B1 * | 10/2001 | Schoenmeyr | 417/244 |
| 6,481,418 | B1 * | 11/2002 | Ristich et al. | 137/510 |
| 2007/0201985 | A1 * | 8/2007 | Hsu | 417/32 |

FOREIGN PATENT DOCUMENTS

| | | | |
|---|---|---|---|
| GB | 2465488 A | * | 5/2010 |
| WO | WO 03/100253 | | 12/2003 |

* cited by examiner

*Primary Examiner* — John Rivell

(74) *Attorney, Agent, or Firm* — Bacon & Thomas, PLLC

(57) ABSTRACT

The present invention provides a vibration reducing device for pump cover body of water shut-off diaphragm pump comprising a hood cover mount and a pump cover body with a containing pit, which orderly accommodates a plastic elastic membrane disk, an obstructing baffle and a compressed spring therein. The plastic elastic membrane disk includes a downward central flow directing buffer, which can insert into a flow directing compartment in the containing pit when the hood cover mount docks with the pump cover body. The flow directing buffer can not only absorb the direct impacting momentum of pumped high pressurized water to the surrounding internal wall of the flow directing compartment but also redirect the random impacting direction of the high pressurized water. Thus, the vibration of the pump cover body with annoying noise created by the impacting momentum of the high pressurized water is deleted.

6 Claims, 21 Drawing Sheets

VIBRATION REDUCING DEVICE FOR PUMP COVER BODY OF WATER SHUT-OFF DIAPHRAGM PUMP

FIELD OF THE PRESENT INVENTION

The present invention relates to a water shut-off diaphragm pump used in a reverse osmosis purification system, particularly for one that can not only absorb the impacting momentum of the high pressurized water to the surrounding internal wall of the flow directing compartment but also redirect the random direction of the high pressurized water so that the vibration of the pump cover body with annoying noise is deleted.

BACKGROUND OF THE INVENTION

Referring to FIGS. 1 through 4, a typical conventional water shut-off diaphragm pump 1 currently used in reverse osmosis water purification system comprises a motor 10 with a plurality of screw bores 12 configured on the peripheral thereof, a motor upper hood chassis 11 with a motor output shaft (not shown in figures), three pumping pistons 13 driven by the motor output shaft to axially move for reciprocally pumping function, a valvular diaphragm cover assembly 20 and a pump cover body 30 with a plurality of perforated bore 37 configured on the peripheral thereof in corresponding with the screw bores 12 on the motor 10; by driving bolts 2 through screw bores 12 on the motor 10 and corresponding perforated bore 37 on the pump cover body 30, the motor 10, the valvular diaphragm cover assembly 20 and the pump cover body 30 can be securely combined into an integral body (as shown in FIG. 2), wherein:

Said valvular diaphragm cover assembly 20 includes an upper valvular cover 21 stacked on a diaphragm 22, a high pressure anti-backflow valve 23 inset in the center of the upper valvular cover 21, three low pressure anti-backflow valves 24 disposed around the peripheral of the high pressure anti-backflow valve 23 in radial manner of evenly sector space and three preliminary low pressure water chambers 25 such that each low pressure water chamber 25 is interposed between each pair of adjacent low pressure anti-backflow valves 24 (as shown in FIGS. 1 and 4);

Said pump cover body 30, which is a hollow body having downward opening with an internal tiered rim 33 encompassing a nested annular well wall 34 in concentric manner, includes a containing pit 301 outwardly configured on the top thereof, an inlet port 31, an outlet port 32 respectively disposed in the peripheral thereof in mutually opposed manner such that both inlet port 31 and outlet port 32 are orthogonal to the containing pit 301 (as shown in FIG. 3) as well as an intensively high-pressured water chamber 35 is created between the internal wall of the annular well wall 34 and top surface of the upper valvular cover 21 when the pump cover body 30 securely docks with the valvular diaphragm cover assembly 20; at this moment, both peripherals of the upper valvular cover 21 and diaphragm 22 as well as the peripheral of the high pressure anti-backflow valve 23 on the valvular diaphragm cover assembly 20 will hermetically attach with each terminal ring of the tiered rim 33 and annular well wall 34 respectively (as shown in FIG. 4); Wherein, a central vertical top opening flow directing compartment 302 with a horizontal outlet passage 36 connecting with the outlet port 32, a vertical annular tunnel 303 and a water passage 304 are created at the lower section of said containing pit 301 so that the high-pressured water chamber 35 and containing pit 301 can be communicable via annular tunnel 303 while the inlet port 31 and containing pit 301 can be communicable via water passage 304 because the annular tunnel 303 encompasses the flow directing compartment 302 with a separating cylinder interposed between them while the water passage 304 externally leads the annular tunnel 303 with a separating cylinder interposed between them (as shown in FIGS. 3 and 4);

From bottom to top orderly imbedded in said pump cover body 30 are a planiform plastic elastic membrane baffle disk 40, an obstructing ring 50 with an annular dent 51 on top surface thereof, a compressed spring 3 and a hood cover mount 60, whose lower section is disposed a downward annular well wall 61 with a plurality of radial flow directing bores 62 created thereon (as shown in FIG. 3), wherein the outer diameter of the obstructing baffle 50 is slightly smaller than inner diameter of the annular well wall 61 so that the obstructing baffle 50 can be inset into the annular well wall 61 of the hood cover mount 60. The assembling steps are as following: firstly, put the elastic membrane baffle disk 40 on the flow directing compartment 302 of the containing pit 301, then attach the obstructing baffle 50 over the elastic membrane baffle disk 40; secondly, put one end of the compressed spring 3 against the annular dent 51 of the obstructing baffle 50, and finally, dock the hood cover mount 60 with the containing pit 301, and then securely fix them by screws. Thereby, the sole surface of the elastic membrane baffle disk 40 can simultaneously block the top openings of the flow directing compartment 302, annular tunnel 303 and water passage 304 by means of stretching force of the compressed spring 3 pushed the annular well wall 61 of the hood cover mount 60 against the elastic membrane baffle disk 40 (as shown in FIG. 4).

Further referring to FIGS. 5 through 7, the operation for the conventional water shut-off diaphragm pump is described as below. Firstly, when the motor 10 is turned on, the tap water W is alternately pumped into three low pressure water chambers 25 orderly via the inlet port 31 of the pump cover body 30 and three low pressure anti-backflow valves 24 by three pumping pistons 13 in axially move for reciprocally pumping function driven by the motor 10 so that the tap water W is preliminarily squeezed into pressurized water Wp of 60 psi~120 psi water pressure in the low pressure water chambers 25 (as indicated by hollow arrowhead shown in FIG. 5); Secondly, the pressurized water Wp of 60 psi~120 psi water pressure is further alternately pumped into the high-pressured water chamber 35 orderly via three sectors of high pressure anti-backflow valve 23 so that the pressurized water Wp of 60 psi~120 psi water pressure is intensively compressed into pressurized water Wp of higher water pressure in the high-pressured water chamber 35; Thirdly, the high pressurized water Wp in the high-pressured water chamber 35 is further pumped into the flow directing compartment 302 orderly via the annular tunnel 303 and elastic membrane baffle disk 40, which is now driven to open by the high pressurized water Wp; and Finally, the high pressurized water Wp in the flow directing compartment 302 is further impelled to discharged out of the water shut-off diaphragm pump 1 orderly via the outlet passage 36 and the outlet port 32 of the pump cover body 30 (as indicated by solid arrowhead shown in FIG. 5) to serve as a supply pressurized water of rated water pressure for being filtered in the RO filter core membrane cartridge of subsequent reverse osmosis purification system.

Further referring to FIG. 7, the shutdown procedure for the conventional water shut-off diaphragm pump is described as below. Firstly, when the motor 10 is turned off, some residual pressurized water Wp in previous operation will be remained in the high-pressured water chamber 35 while the tap water W is driven into the containing pit 301 orderly via the inlet port 31 and water passage 304 of the pump cover body 30 (as indicated by hollow arrowhead shown in FIG. 7); Secondly, the tap water W in the containing pit 301 is further driven into hollow space encompassed by the annular well wall 61 via the flow directing bores 62 of the annular well wall 61 in the hood cover mount 60; and Finally, the combined downward force by the water pressure of the tap water W in the hollow space encompassed by the annular well wall 61 and the resilient force of the compressed spring 3 will push the obstructing ring 50 and elastic membrane baffle disk 40 downwardly to block the annular tunnel 303 because the combined downward force is greater than the upward water pressure of the residual pressurized water Wp remained in the high-pressured water chamber 35. Thus, the residual pressurized water Wp remained in the high-pressured water chamber 35 is blocked and disabled to flow into the flow directing compartment 302 (as shown in FIG. 7) for being discharged out of the water shut-off diaphragm pump 1 to serve as a supply pressurized water in the subsequent reverse osmosis purification system so that the automatically water shut-off function is achieved.

Further referring to FIGS. 5 and 6, the drawback in the operation for the conventional water shut-off diaphragm pump is described as below. As described in foregoing normal operation, the tap water W is firstly pumped by three pumping pistons 13, which is driven by the motor 10, into the low pressure water chambers 25 to become high pressurized water Wp, which is further pumped into the flow directing compartment 302 orderly via the annular tunnel 303 and elastic membrane baffle disk 40 from the high-pressured water chambers 35. Suppose the motor 10 rotates in 700 revolutions per minute (700 RPM), 2100 times per minute of high pressurized water Wp will be pumped into the flow directing compartment 302 since each of three pumping pistons 13 is alternately driven one time by each revolution of the motor 10. Consequently, the momentum frequency of the high pressurized water Wp in the flow directing compartment 302 will be 2100 times per minute before the high pressurized water Wp flows to the outlet passage 36 (as shown in FIG. 5). Wherein, the impacting direction from the momentum of the high pressurized water Wp to the surrounding internal wall of the flow directing compartment 302 is in random manner (as indicated by enlarged view shown in FIG. 6). Thereby, under such high frequency of the momentum by the high pressurized water Wp, vibration of the pump cover body 30 with annoying noise is created. Once the water shut-off diaphragm pump 1 is powered on to operate for being used in subsequent reverse osmosis purification system, the user must be suffered from such annoying noise thereof. Chronically, the annoying noise not only disturbs the peaceful household environment but also jeopardizes to the human health. Therefore, how to effectively delete the annoying noise becomes a critical issue for the manufacturers of the water shut-off diaphragm pump. However, no effective and simple solution is worked out up to now.

SUMMARY OF THE INVENTION

Having addressed at foregoing critical drawback in the conventional water shut-off diaphragm pump together with frequently penetrating research and tests, the applicant of the present invention eventually works out a novel contrivance with simple structure as effective solution. The primary object of the present invention is to provide a "vibration reducing device for pump cover body of water shut-off diaphragm pump" comprising a hood cover mount and a pump cover body with a containing pit, which orderly accommodates a plastic elastic membrane disk, an obstructing baffle and a compressed spring therein. The plastic elastic membrane disk includes a downward central flow directing buffer, which can insert into a flow directing compartment in the containing pit when the hood cover mount docks with the pump cover body. The flow directing buffer can not only absorb the direct impacting momentum of the high pressurized water to the surrounding internal wall of the flow directing compartment but also redirect the random impacting direction of the high pressurized water.

The other object of the present invention is to provide a "vibration reducing device for pump cover body of water shut-off diaphragm pump" with a flow directing buffer. By means of the flow directing buffer, the high pressurized water is fully guided into the outlet passage as a steady flow. Thus, the vibration of the pump cover body with annoying noise created by the impacting momentum of the high pressurized water, which happened in the conventional water shut-off diaphragm pump, is deleted. Consequently, not only the annoying noise disturbing the peaceful household environment is completely deleted but also the human health is no longer to be jeopardized.

DETAILED DESCRIPTION OF THE PREFERRED EMBODIMENTS

Figure 2:
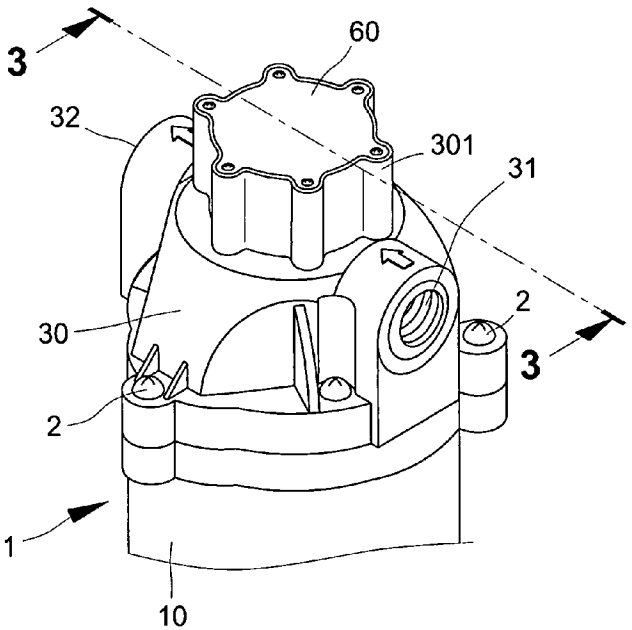
Fig. 2 (Prior Art)
FIG. 2 is an assembly perspective view for a conventional water shut-off diaphragm pump.
Figure 1:
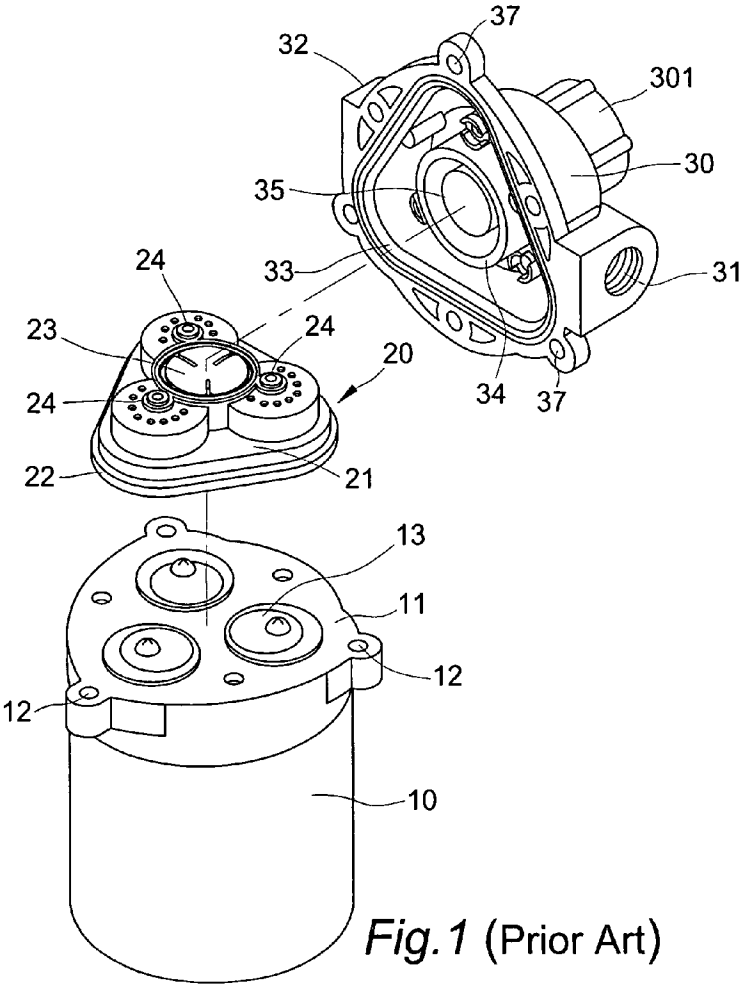
Fig. 1 (Prior Art)
FIG. 1 is an exploded perspective view for a conventional water shut-off diaphragm pump.
Figure 3:
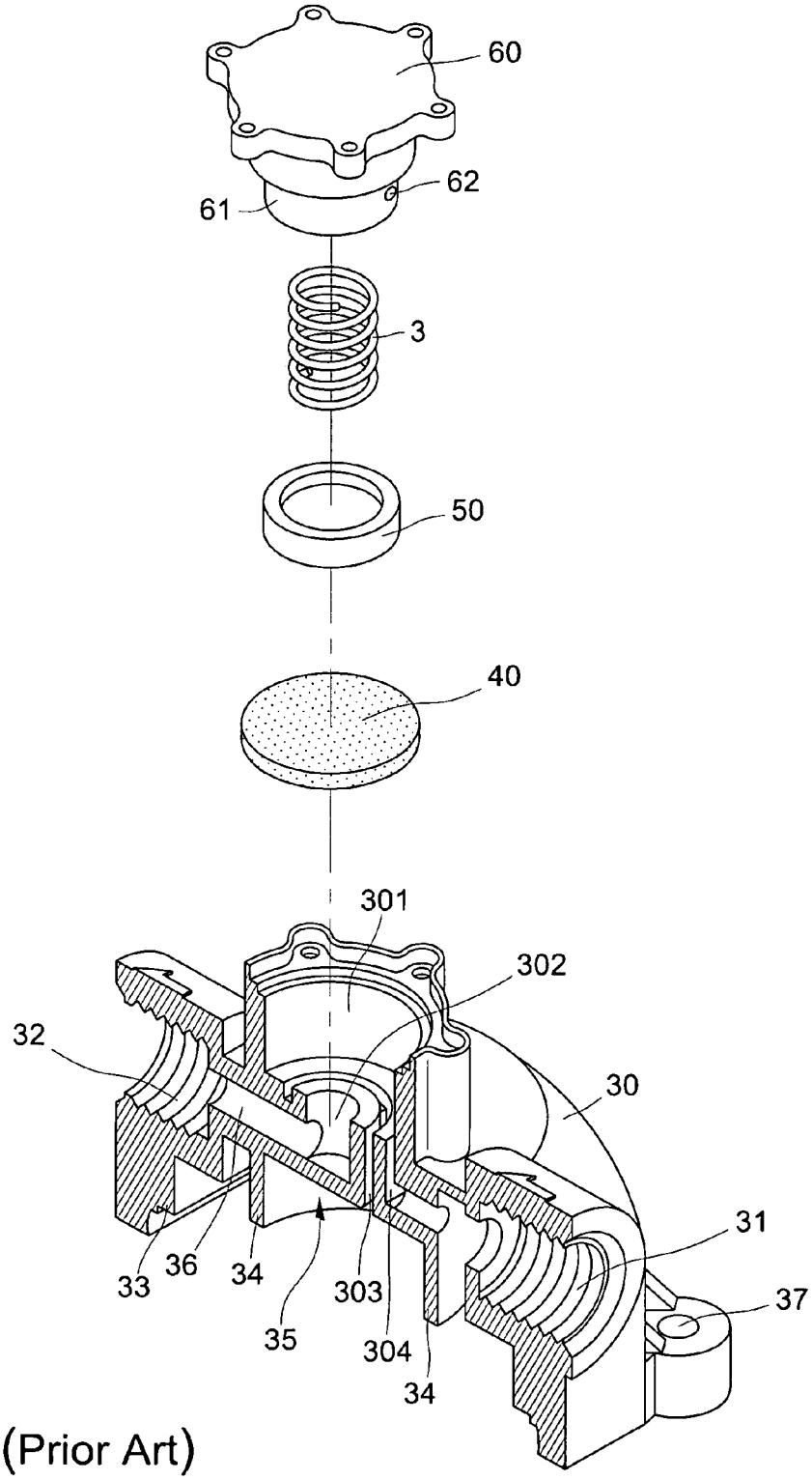
Fig.3 (Prior Art)
FIG. 3 is an exploded perspective view for pump cover body of a conventional water shut-off diaphragm pump.
Figure 4:
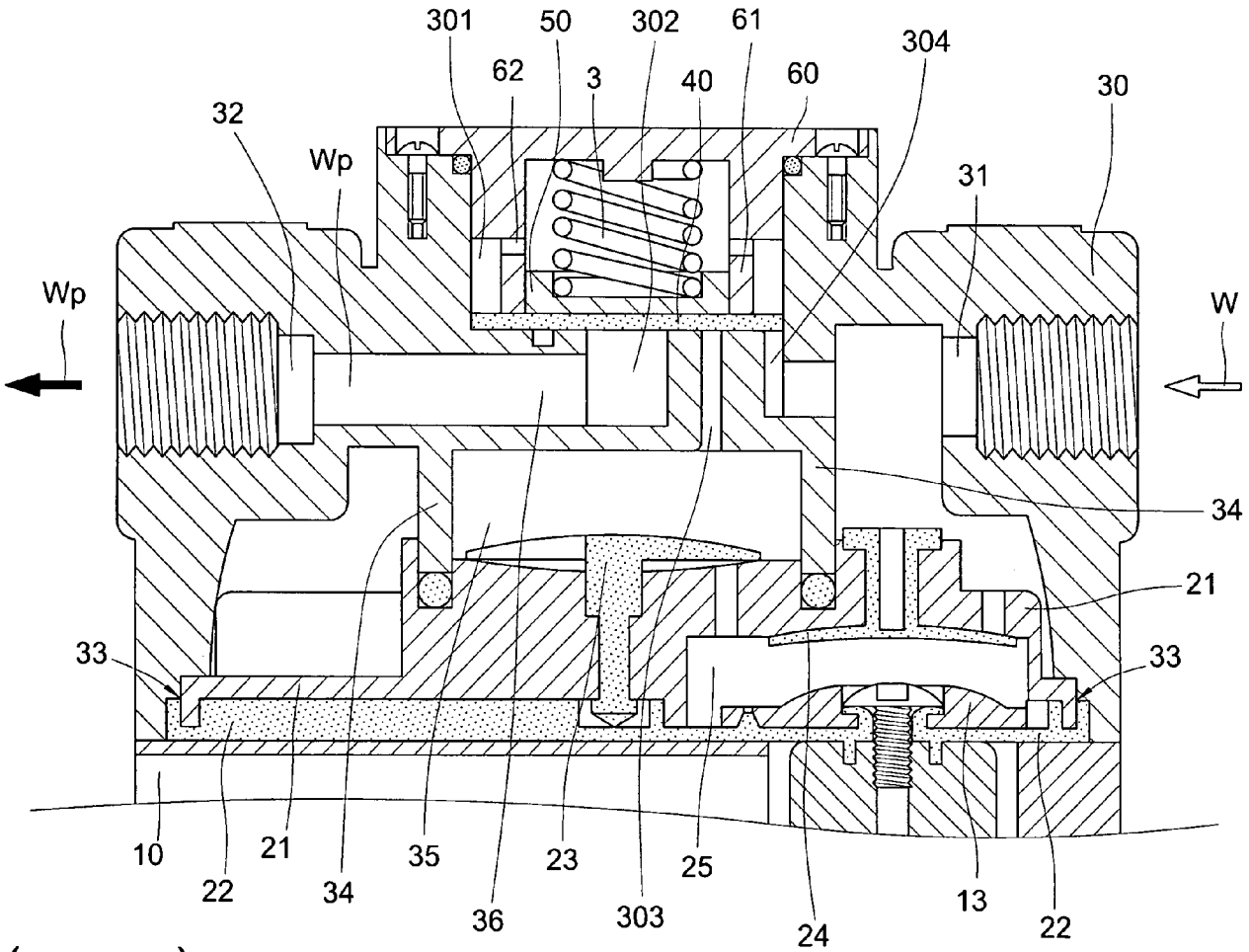
Fig.4 (Prior Art)
FIG. 4 is a sectional view taken along line 3-3 as indicated in FIG. 2.
Figure 5:
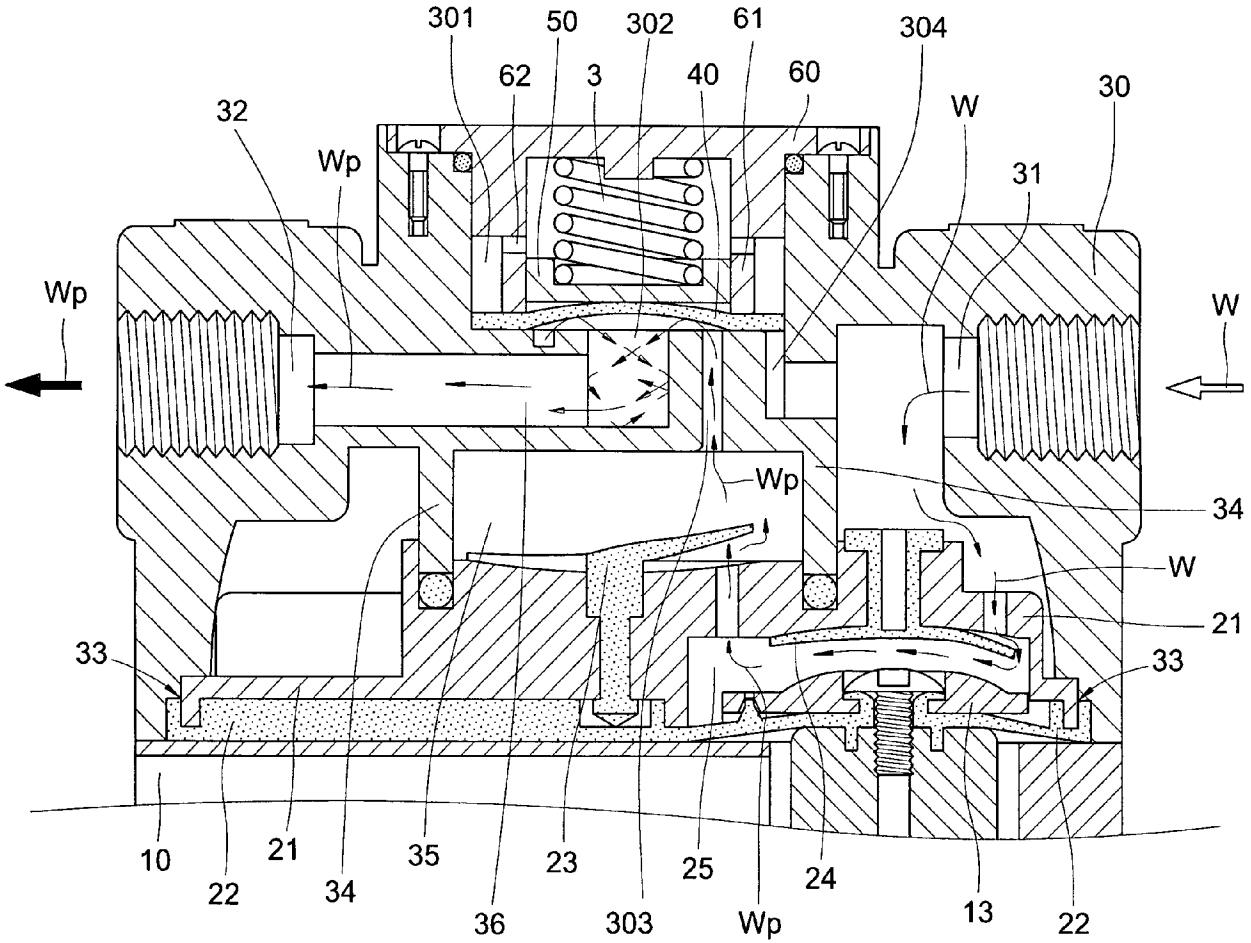
Fig.5 (Prior Art)
FIG. 5 is the first operational schematic view for a conventional water shut-off diaphragm pump.
Figure 6:
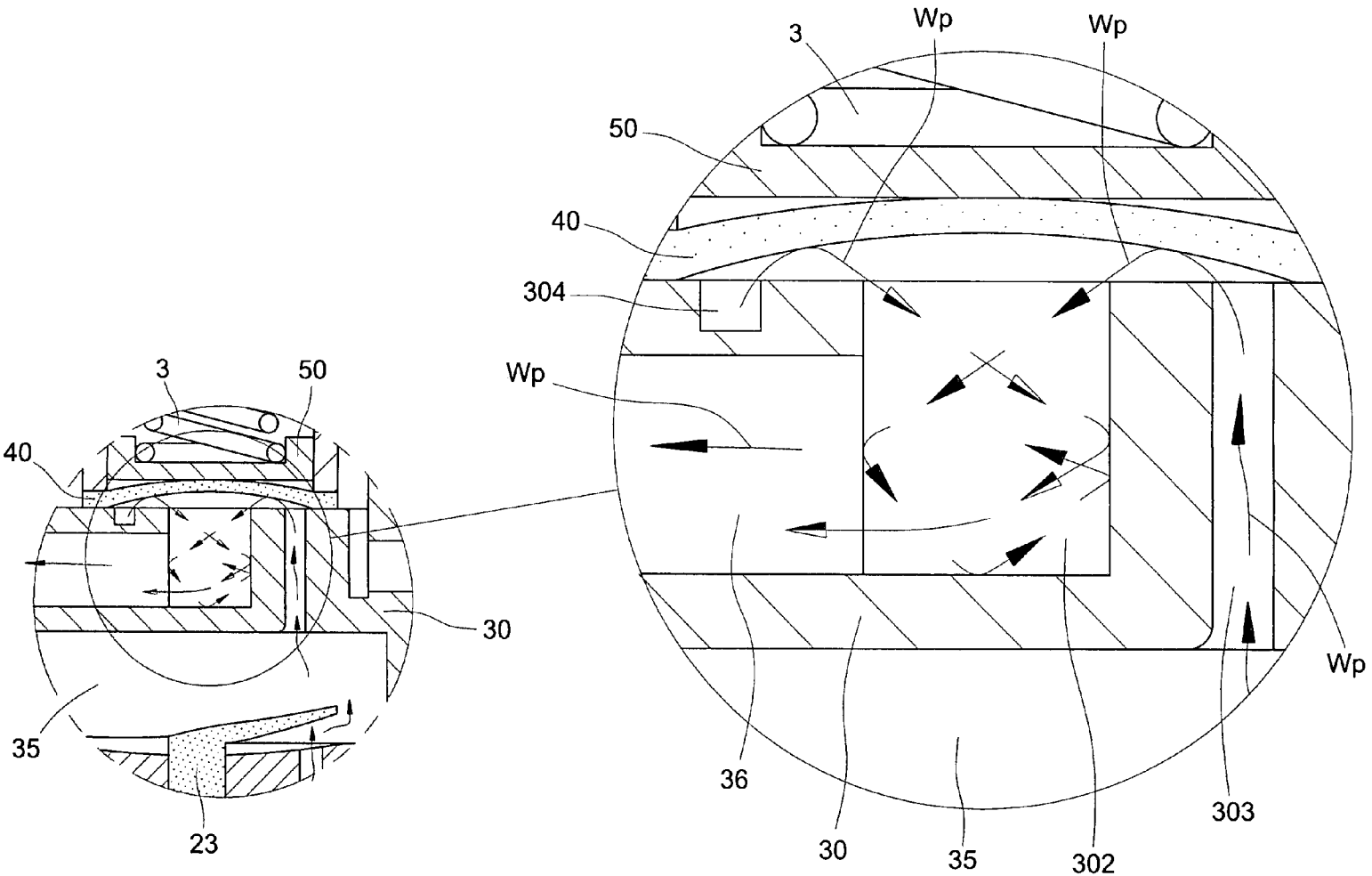
Fig.6 (Prior Art)
FIG. 6 is a partially enlarged view taken from circled portion of previous FIG. 5.
Figure 7:
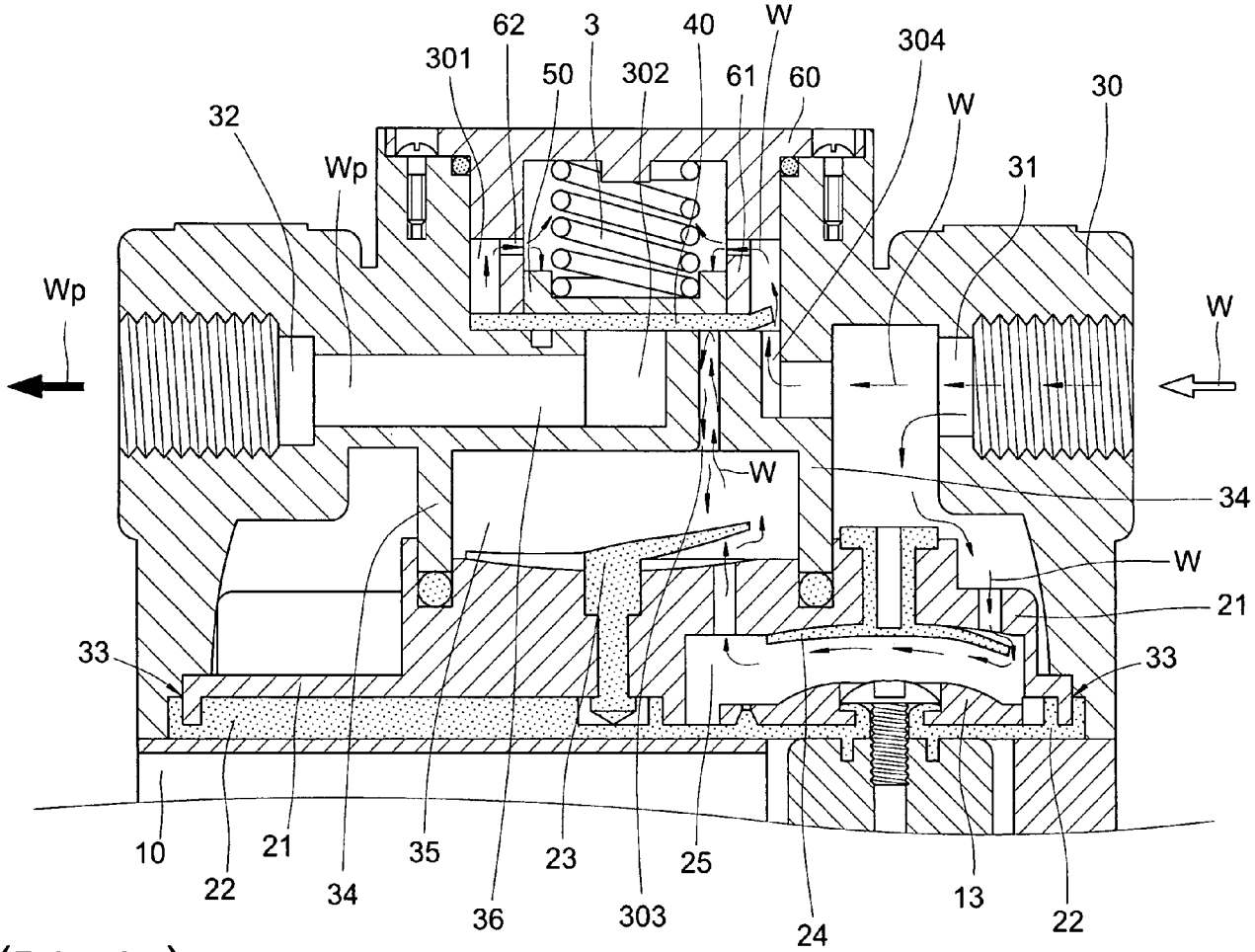
Fig. 7 (Prior Art)
FIG. 7 is the second operational schematic view for a conventional water shut-off diaphragm pump.
Figure 8:
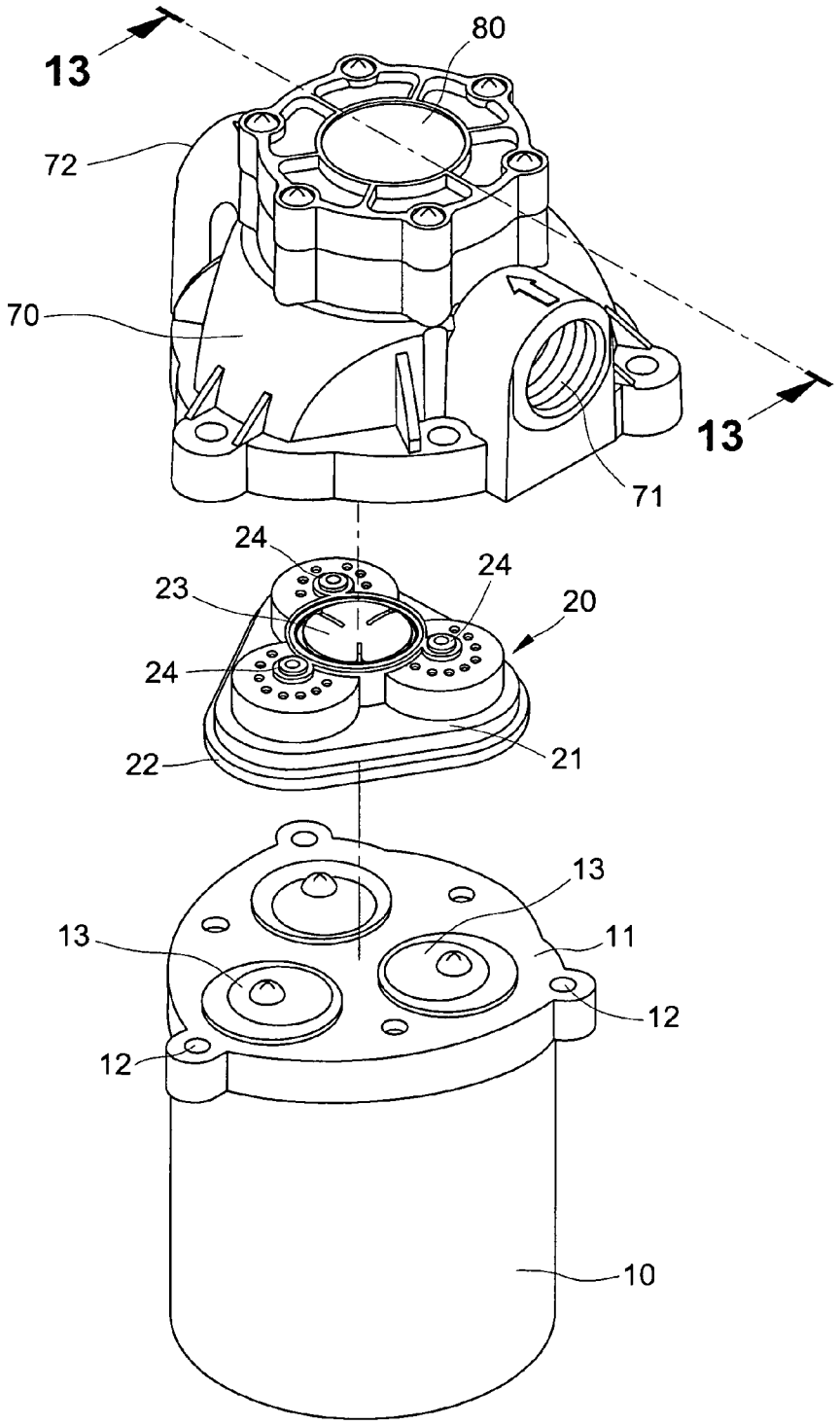
FIG. 8 is an exploded perspective view for combination of a conventional water shut-off diaphragm pump with associated motor and the present invention.

Referring to FIGS. 8 through 13, a vibration reducing device for pump cover body of water shut-off diaphragm pump according to a first preferred embodiment of the present invention comprises a pump cover body 70, a hood cover mount 80, a plastic elastic membrane disk 90, an obstructing baffle 100 and a compressed spring 3.

Figure 9:
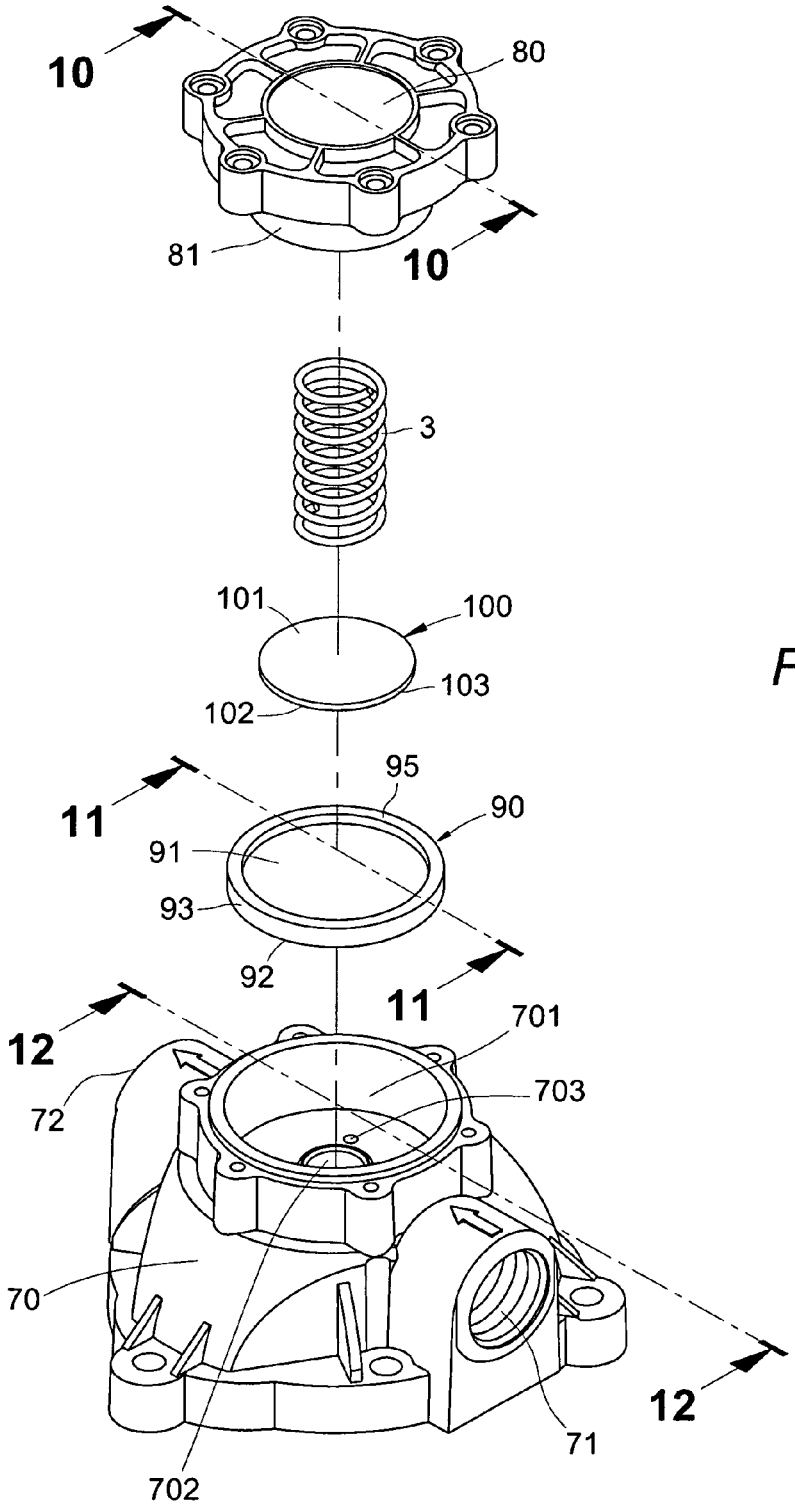
FIG. 9 is an exploded perspective view for a vibration reducing device for pump cover body of water shut-off diaphragm pump according to a first preferred embodiment of the present invention.
Figure 12:
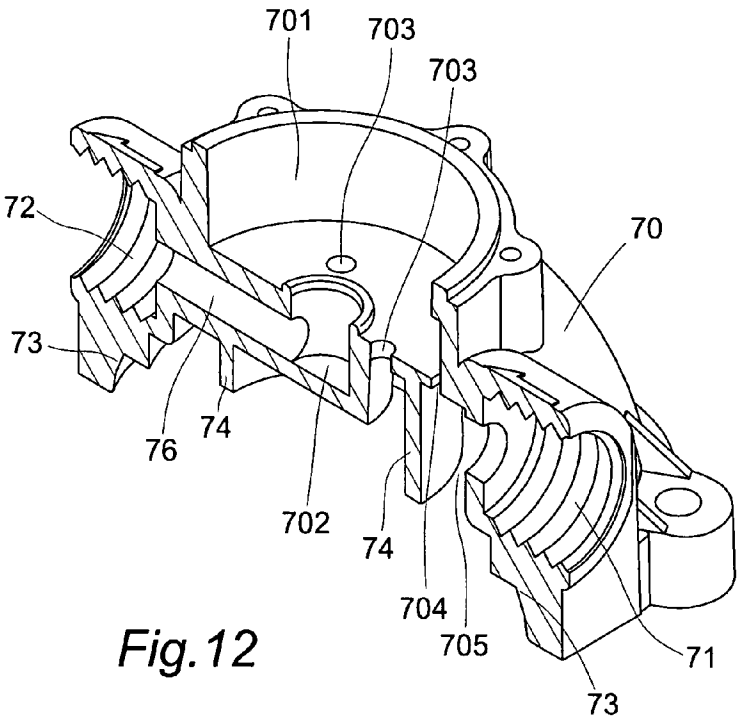
FIG. 12 is a sectional perspective view taken along line 12-12 as indicated in FIG. 9.
Figure 10:
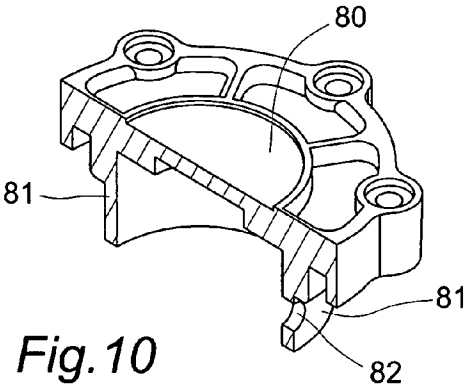
FIG. 10 is a sectional perspective view taken along line 10-10 as indicated in FIG. 9.
Figure 11:
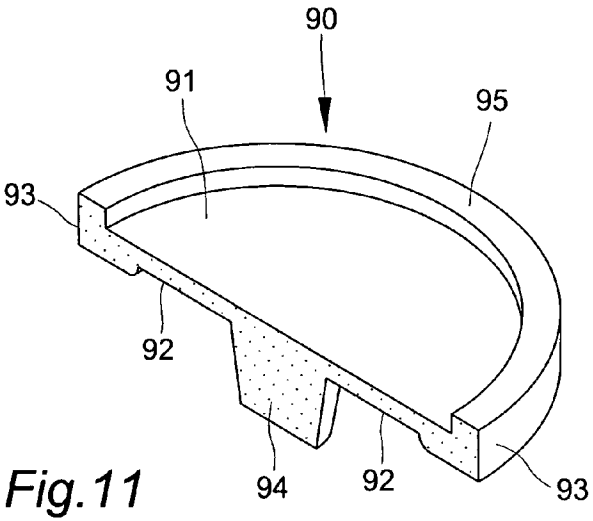
FIG. 11 is a sectional perspective view taken along line 11-11 as indicated in FIG. 9.
Figure 13:
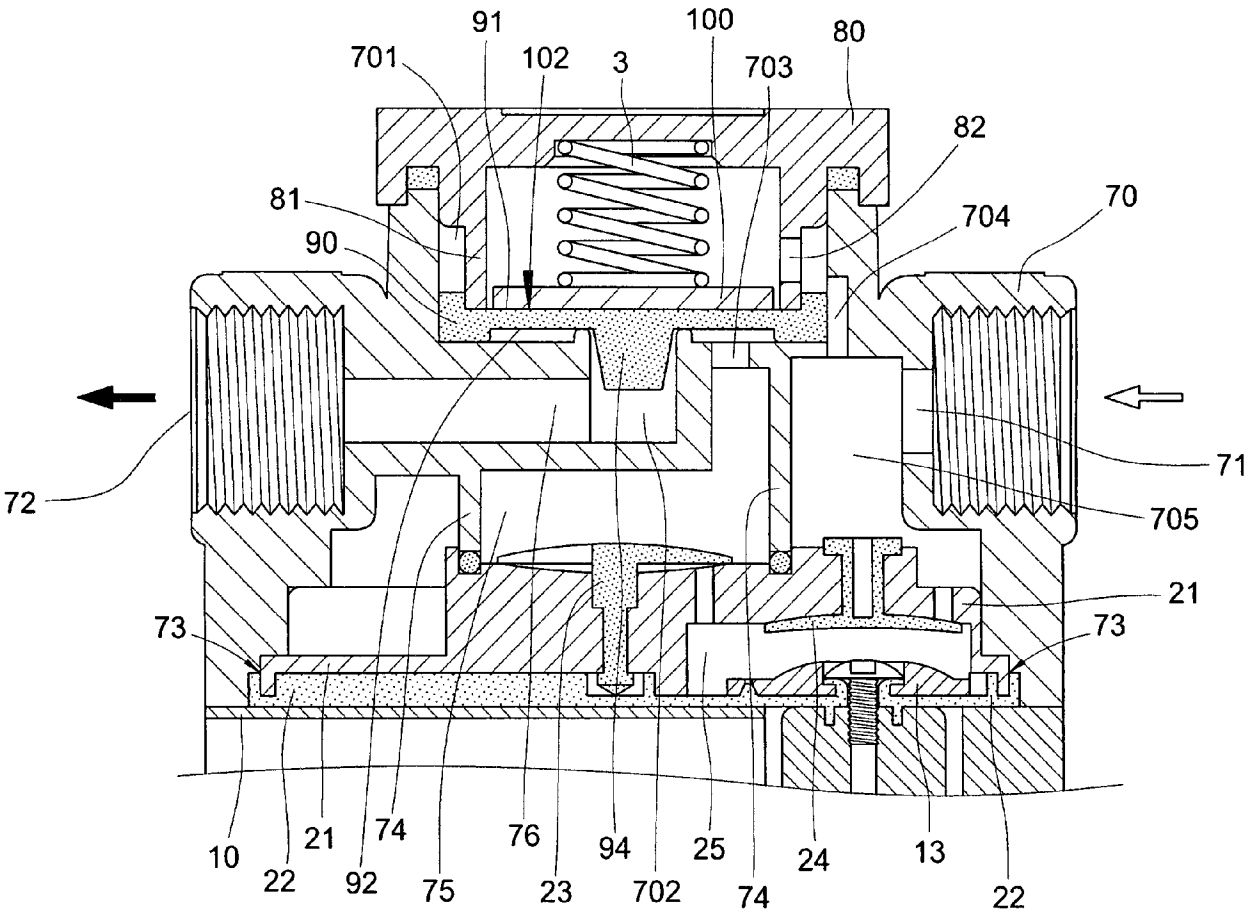
FIG. 13 is a sectional view taken along line 13-13 as indicated in FIG. 8.

Referring to FIGS. 8 through 13, the pump cover body 70 is a hollow body having downward opening with an internal tiered rim 73 encompassing a nested annular well wall 74 in concentric manner, includes a containing pit 701 outwardly configured on the top thereof, an inlet port 71, an outlet port 72 respectively disposed in the peripheral thereof in mutually opposed manner such that both inlet port 71 and outlet port 72 are orthogonal to the containing pit 701 (as shown in FIG. 12) as well as an intensively high-pressured water chamber 75 is created between the internal wall of the annular well wall 74 and top surface of the upper valvular cover 21 when the pump cover body 70 securely docks with the valvular diaphragm cover assembly 20; at this moment, both peripherals of the upper valvular cover 21 and diaphragm 22 as well as the peripheral of the high pressure anti-backflow valve 23 on the valvular diaphragm cover assembly 20 will hermetically attach with each terminal ring of the tiered rim 73 and annular well wall 74 respectively (as shown in FIG. 13); Wherein, a central vertical top opening flow directing compartment 702 with a horizontal outlet passage 76 connecting with the outlet port 72, a plurality of vertical perforated bores 703 and a water passage 704 with a leading space 705 are created at the lower section of said containing pit 701 so that the high-pressured water chamber 75 and containing pit 701 can be communicable via perforated bores 703 while the inlet port 71 with the leading space 705 and containing pit 701 can be communicable via water passage 704 because the perforated bores 703 surrounds the flow directing compartment 702 with a separating cylinder interposed between them while the water passage 704 externally leads the perforated bores 703 with a separating cylinder interposed between them (as shown in FIGS. 12 and 13);

The hood cover mount 80 is inset in the containing pit 701 of the pump cover body 70, has a closed top and a downward annular well wall 81 with a plurality of radial flow directing bores 82 disposed on the lower section (as shown in FIG. 10);

The plastic elastic membrane disk 90, which attaches on the upper opening of the flow directing compartment 702 in the pump cover body 70, includes a top surface 91, a sole surface 92, an outer peripheral 93, a downward central flow directing buffer 94 and a marginal raised rim 95 abutting the joint of the top surface 91 and outer peripheral 93 (as shown in FIG. 11), wherein the shape of the flow directing buffer 94 can be a cylinder, cone or inverted cone;

The obstructing baffle 100, which is a planiform plastic disk to be attached on the top surface 91 of the elastic membrane disk 90, includes a top surface 101, a sole surface 102 and an outer peripheral 103 jointing the top surface 101 and sole surface 102 as an integral (as shown in FIG. 9), wherein the outer diameter of the obstructing baffle 100 is slightly smaller than inner diameter of the annular well wall 81 so that the obstructing baffle 100 can be inset into the annular well wall 81 of the hood cover mount 80; and The compressed spring 3 has one end thereof attached against the top surface 101 of the obstructing baffle 100 and the other end thereof attached against the bottom rim for the annular well wall 81 of the hood cover mount 80.

Wherein, the shape of the flow directing buffer 94 on the elastic membrane disk 90 is a cylinder, cone or inverted cone.

Referring to FIG. 13, the assembling process for a first preferred embodiment of the present invention is described as below. Firstly, put the elastic membrane disk 90 into the containing pit 701 by aligning the flow directing buffer 94 with the flow directing compartment 702 so that the flow directing buffer 94 at the sole surface 92 of the elastic membrane disk 90 will simultaneously insert into the flow directing compartment 702 of the containing pit 701; secondly, attach the sole surface 102 of the obstructing baffle 100 on the top surface 91 of the elastic membrane disk 90, then put one end of the compressed spring 3 against the obstructing baffle 100; and finally, dock the hood cover mount 80 with the containing pit 701 of the pump cover body 70, and then securely fix them by screws. Thereby, the sole surface 92 of the elastic membrane disk 90 can simultaneously block the top openings of the flow directing compartment 702, perforated bore 703 and water passage 704 by means of stretching force of the compressed spring 3 pushed the annular well wall 81 of the hood cover mount 80 against the top surface 91 of the elastic membrane disk 90.

Figure 14:
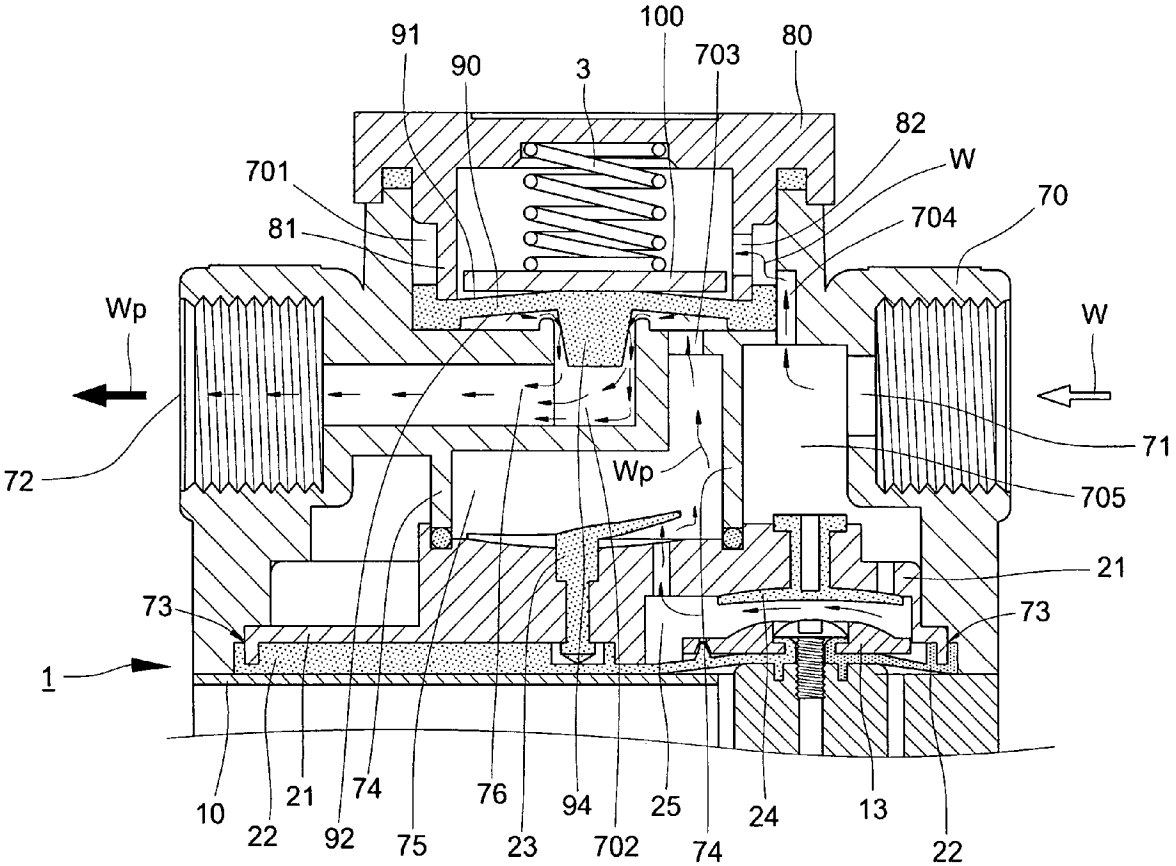
FIG. 14 is the first operational schematic view for the above first embodiment of the present invention.
Figure 15:
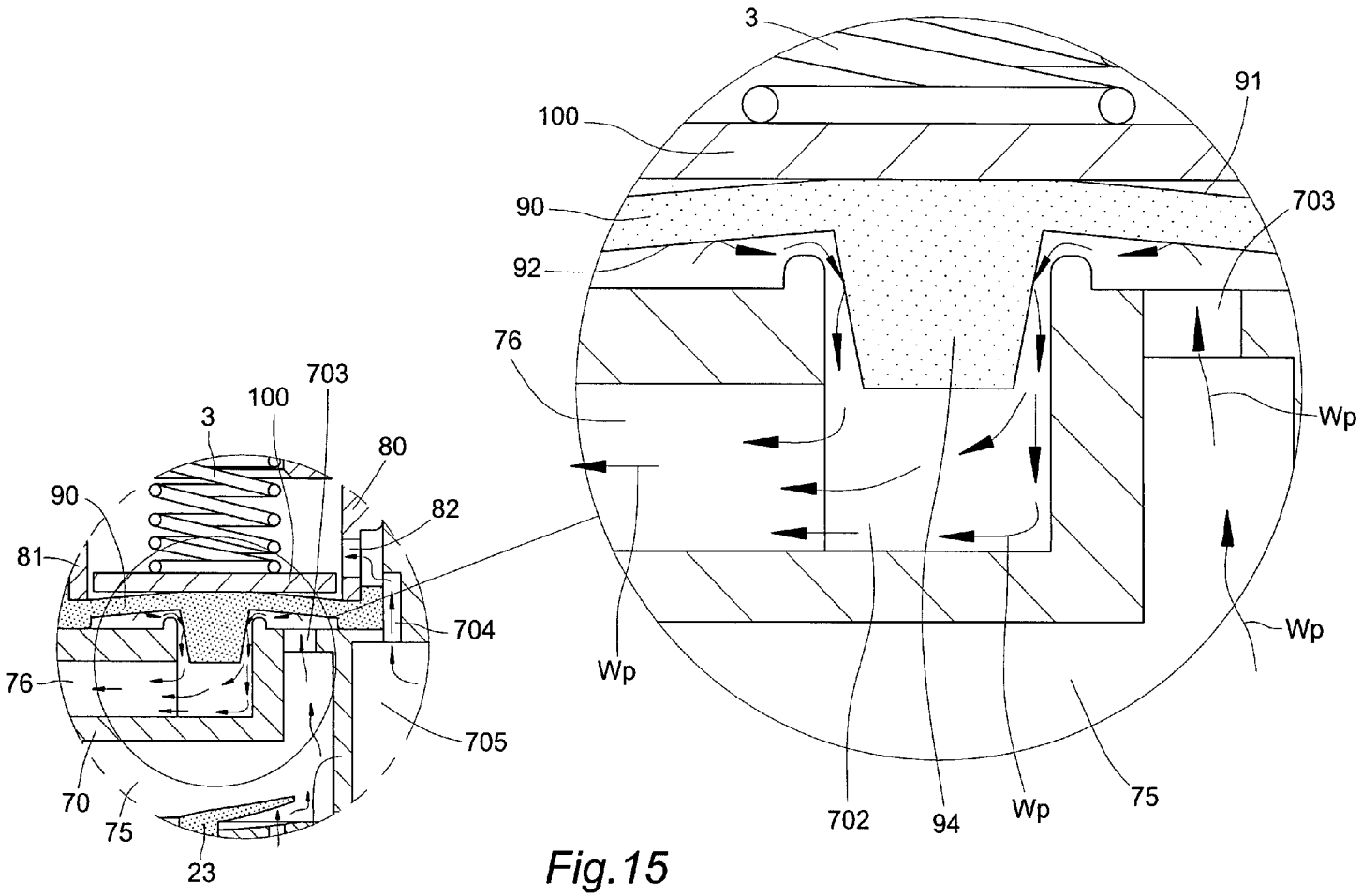
FIG. 15 is a partially enlarged view taken from circled portion of previous FIG. 14.
Figure 16:
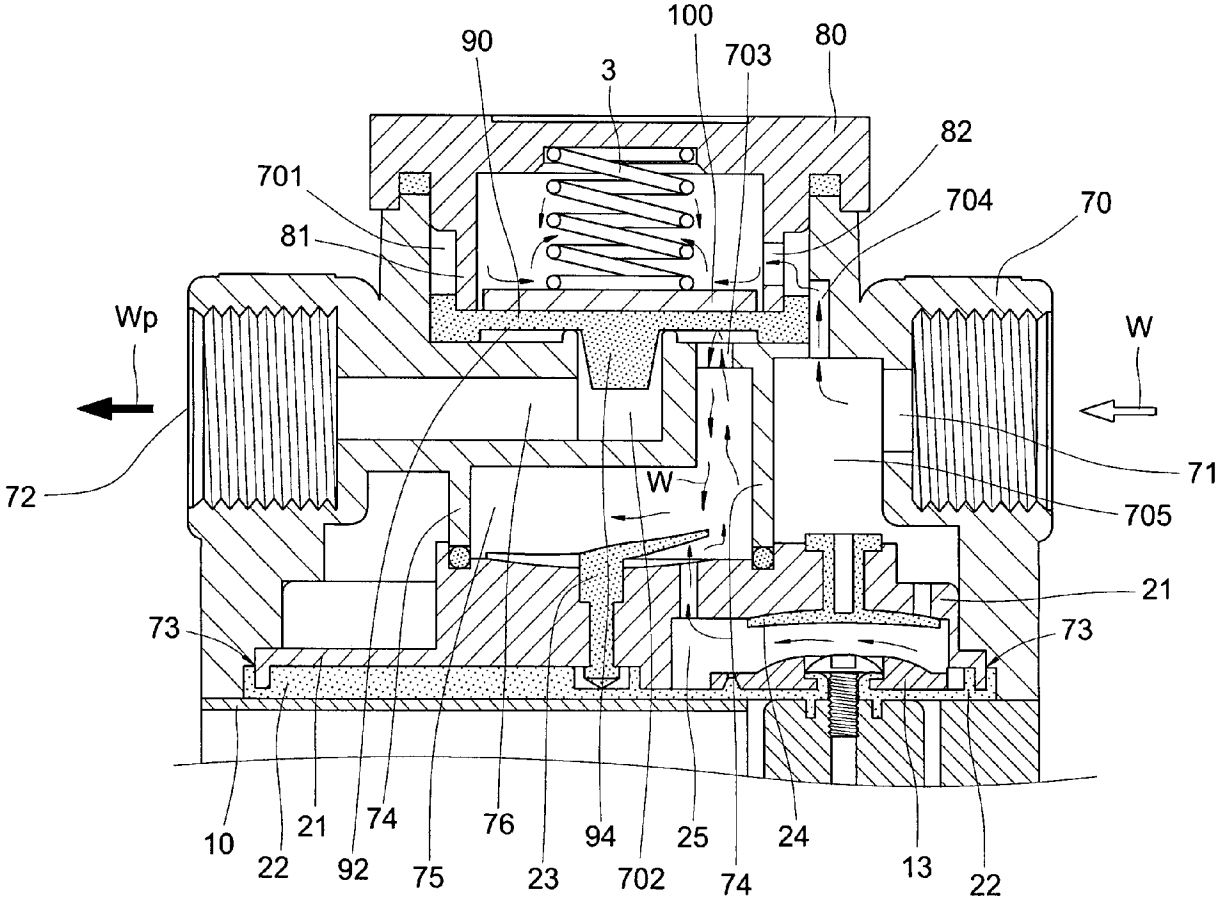
FIG. 16 is the second operational schematic view for the above first embodiment of the present invention.

Referring to FIGS. 14 through 16, after having the foregoing first preferred embodiment of the present invention combined with the motor 10 and valvular diaphragm cover assembly 20 to become as an integral system, the operation for the integral system is described as below. Firstly, when the motor 10 is turned on, the tap water W is alternately pumped into three low pressure water chambers 25 orderly via the inlet port 71 of the pump cover body 70 and three low pressure anti-backflow valves 24 by three pumping pistons 13 in axially move for reciprocally pumping function driven by the motor 10 so that the tap water W is preliminarily squeezed into pressurized water Wp of 60 psi~120 psi water pressure in the low pressure water chambers 25 (as indicated by hollow arrowhead shown in FIG. 14); Secondly, the pressurized water Wp of 60 psi~120 psi water pressure is further alternately pumped into the high-pressured water chamber 75 orderly via three sectors of high pressure anti-backflow valve 23 so that the pressurized water Wp of 60 psi~120 psi water pressure is intensively compressed into pressurized water Wp of higher water pressure in the high-pressured water chamber 75; Thirdly, the high pressurized water Wp in the high-pressured water chamber 75 is further pumped into the flow directing compartment 702 orderly via the perforated bores 703 and elastic membrane disk 90, which is now driven to open by the high pressurized water Wp; and Finally, the high pressurized water Wp in the flow directing compartment 702 is further impelled to discharged out of the water shut-off diaphragm pump 1 orderly via the outlet passage 76 and the outlet port 72 of the pump cover body 70 (as indicated by solid arrowhead shown in FIG. 14) to serve as a supply pressurized water of rated water pressure for being filtered in the RO filter core membrane cartridge of subsequent reverse osmosis purification system.

Further referring to FIG. 16, the shutdown procedure for the integral system is described as below. Firstly, when the motor 10 is turned off, some residual pressurized water Wp in previous operation will be remained in the high-pressured water chamber 75 while the tap water W is driven into the containing pit 701 orderly via the inlet port 71 and water passage 704 of the pump cover body 70 (as indicated by hollow arrowhead shown in FIG. 16); Secondly, the tap water W in the containing pit 701 is further driven into hollow space encompassed by the annular well wall 81 via the flow directing bores 82 of the annular well wall 81 in the hood cover mount 80; and Finally, the combined downward force by the water pressure of the tap water W in the hollow space encompassed by the annular well wall 81 and the resilient force of the compressed spring 3 will push the obstructing baffle 100 and elastic membrane disk 90 downwardly to block the perforated bore 703 because the combined downward force is greater than the upward water pressure of the residual pressurized water Wp remained in the high-pressured water chamber 75. Thus, the residual pressurized water Wp remained in the high-pressured water chamber 75 is blocked and disabled to flow into the flow directing compartment 702 (as shown in FIG. 16) for being discharged out of the water shut-off diaphragm pump 1 to serve as a supply pressurized water in the subsequent reverse osmosis purification system so that the automatically water shut-off function is achieved.

Further referring to FIGS. 14 and 15, the drawback in the operation for the conventional water shut-off diaphragm pump is deleted by the present invention as below. As described in foregoing normal operation, the tap water W is firstly pumped by three pumping pistons 13, which is driven by the motor 10, into the low pressure water chambers 25 to become high pressurized water Wp, which is further pumped into the flow directing compartment 702 orderly via the perforated bore 703 and elastic membrane disk 90 from the high-pressured water chambers 75. Wherein, the downward flow directing buffer 94 on the sole surface 92 of the elastic membrane disk 90 not only absorbs the direct impacting momentum of the high pressurized water Wp to the surrounding internal wall of the flow directing compartment 702 but also redirects the random impacting direction of the high pressurized water Wp so that the high pressurized water Wp is fully guided into the outlet passage 76 as a steady flow (as indicated by enlarged view shown in FIG. 15 as well as indicated by arrowheads shown in FIGS. 14 and 15). Thus, the vibration of the pump cover body 70 with annoying noise created by the impacting momentum of the high pressurized water Wp, which happened in the conventional water shut-off diaphragm pump 1, is deleted. Consequently, not only the annoying noise disturbing the peaceful household environment is completely deleted but also the human health is no longer to be jeopardized.

Figure 17:
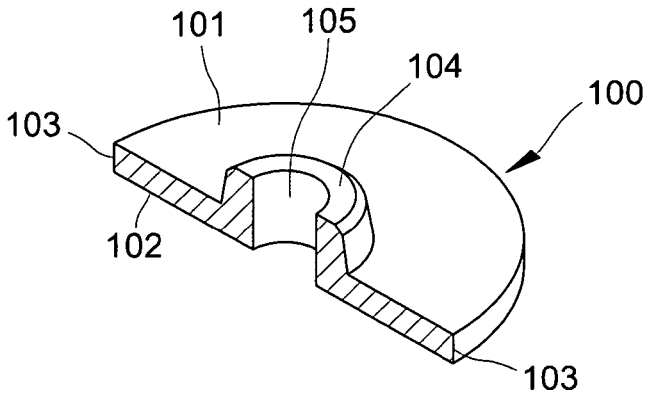
FIG. 17 is a sectional perspective view for an obstructing baffle in the second preferred embodiment of the present invention.
Figure 18:
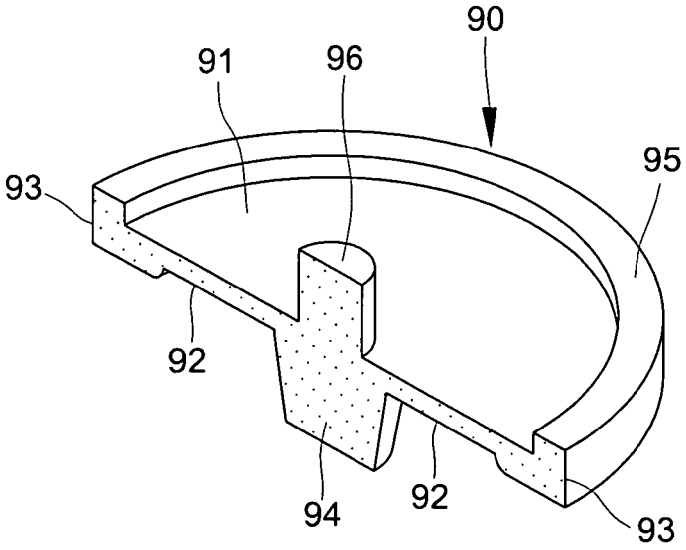
FIG. 18 is a sectional perspective view for an elastic membrane disk in the second preferred embodiment of the present invention.
Figure 19:
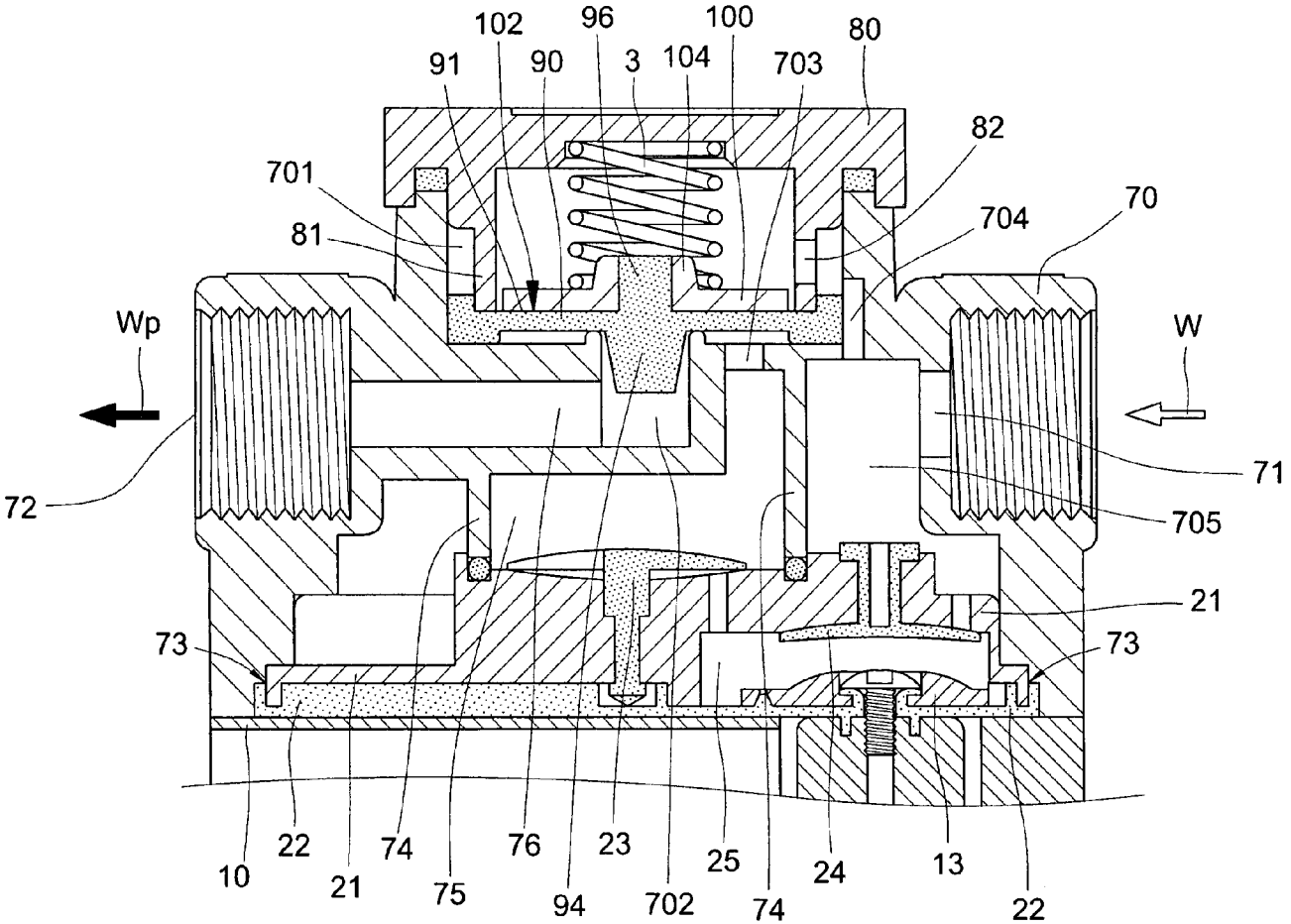
FIG. 19 is a sectional view for a second preferred embodiment of the present invention.
Figure 20:
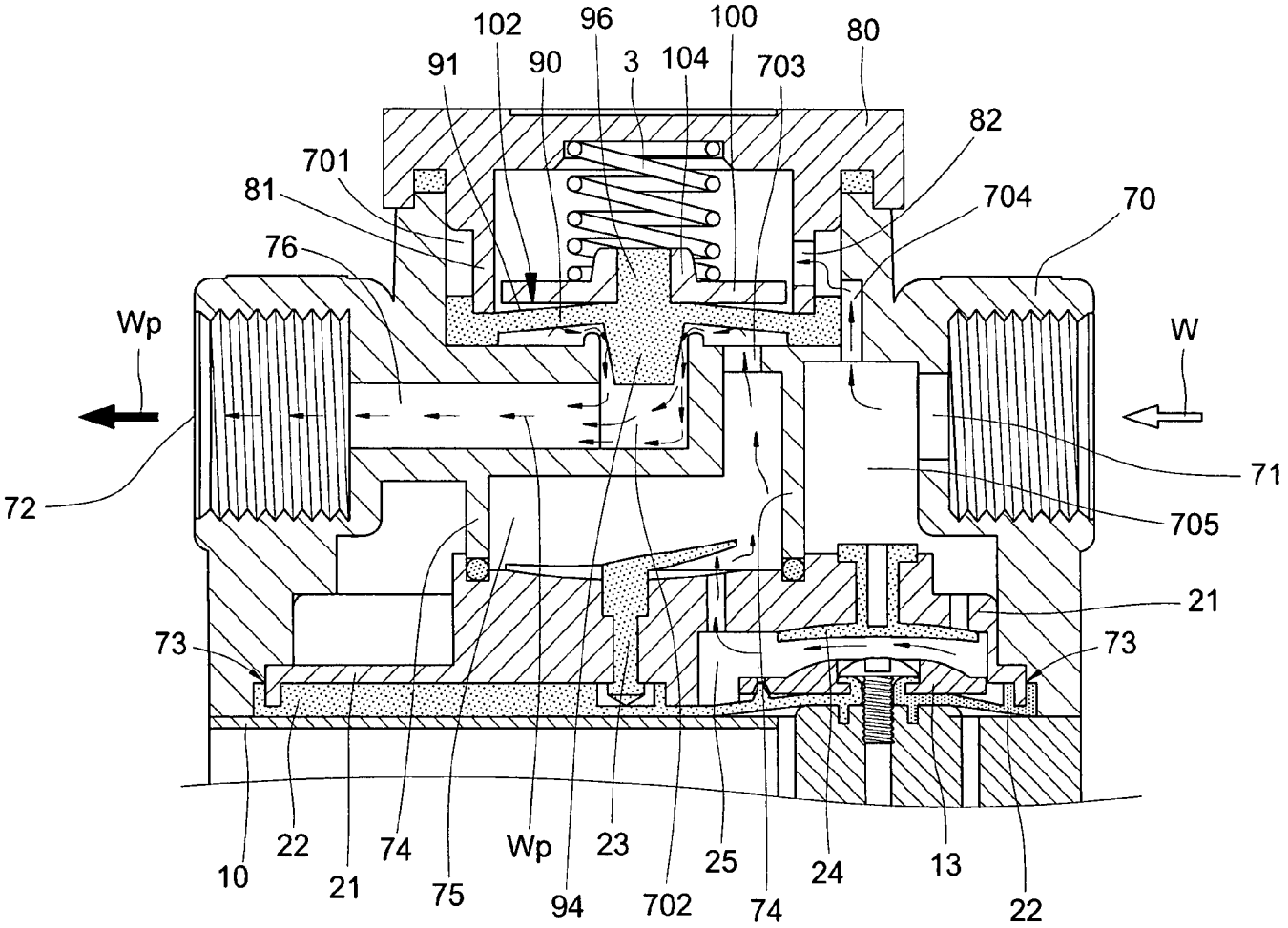
FIG. 20 is a sectional operational view for a second preferred embodiment of the present invention.

Referring to FIGS. 17 through 20, they show a modified elastic membrane disk in the second exemplary embodiment of the present invention. Wherein, the modified elastic membrane disk 90 is further disposed a central orientating shaft 96 on the top surface 91 thereof (as shown in FIG. 18) while the obstructing baffle 100 is also adapted to create an additional central orientated base 104 with an orientated hole 105 therein to receive the corresponding orientating shaft 96 (as shown in FIG. 17). By firmly inserting the orientating shaft 96 into the corresponding orientated hole 105, the elastic membrane disk 90 can securely dock with the obstructing baffle 100 without any shifting and rocking movement when the pressurized water Wp upwardly rushes against the elastic membrane disk 90 and obstructing baffle 100. Thus, not only the relative orientation and distance between the downward flow directing buffer 94 and the internal wall of the flow directing compartment 702 are surely kept but also the redirecting and buffer functions of the flow directing buffer 94 are enhanced (as shown in FIG. 20).

Figure 23:
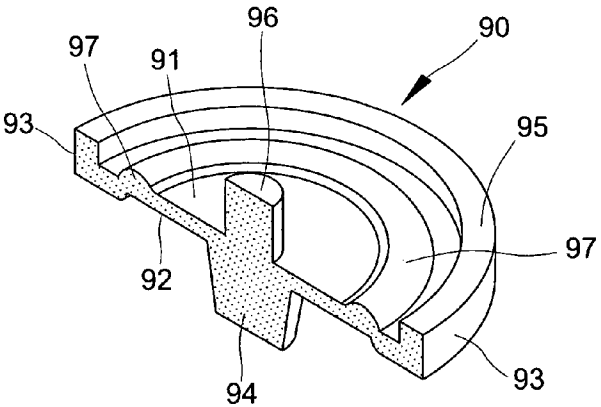
FIG. 23 is a sectional perspective view for an elastic membrane disk in the third preferred embodiment of the present invention.
Figure 24:
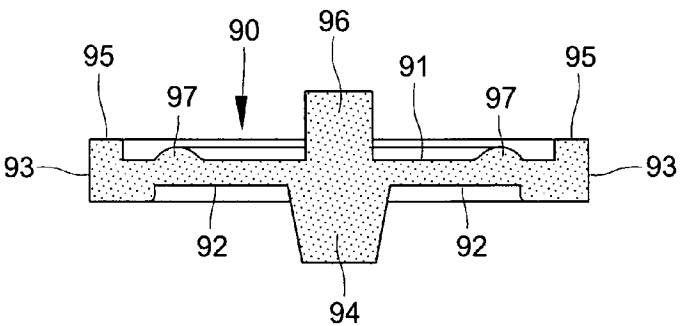
FIG. 24 is a sectional view for an elastic membrane disk in the third preferred embodiment of the present invention.
Figure 21:
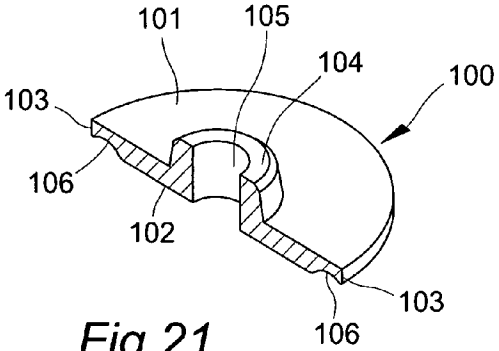
FIG. 21 is a sectional perspective view for an obstructing baffle in the third preferred embodiment of the present invention.
Figure 22:
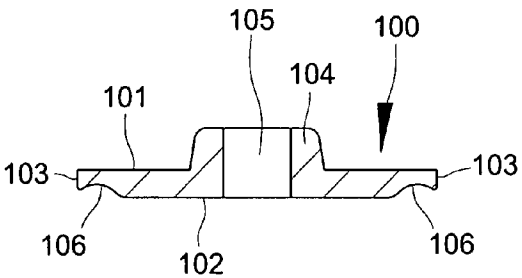
FIG. 22 is a sectional view for an obstructing baffle in the third preferred embodiment of the present invention.
Figure 25:
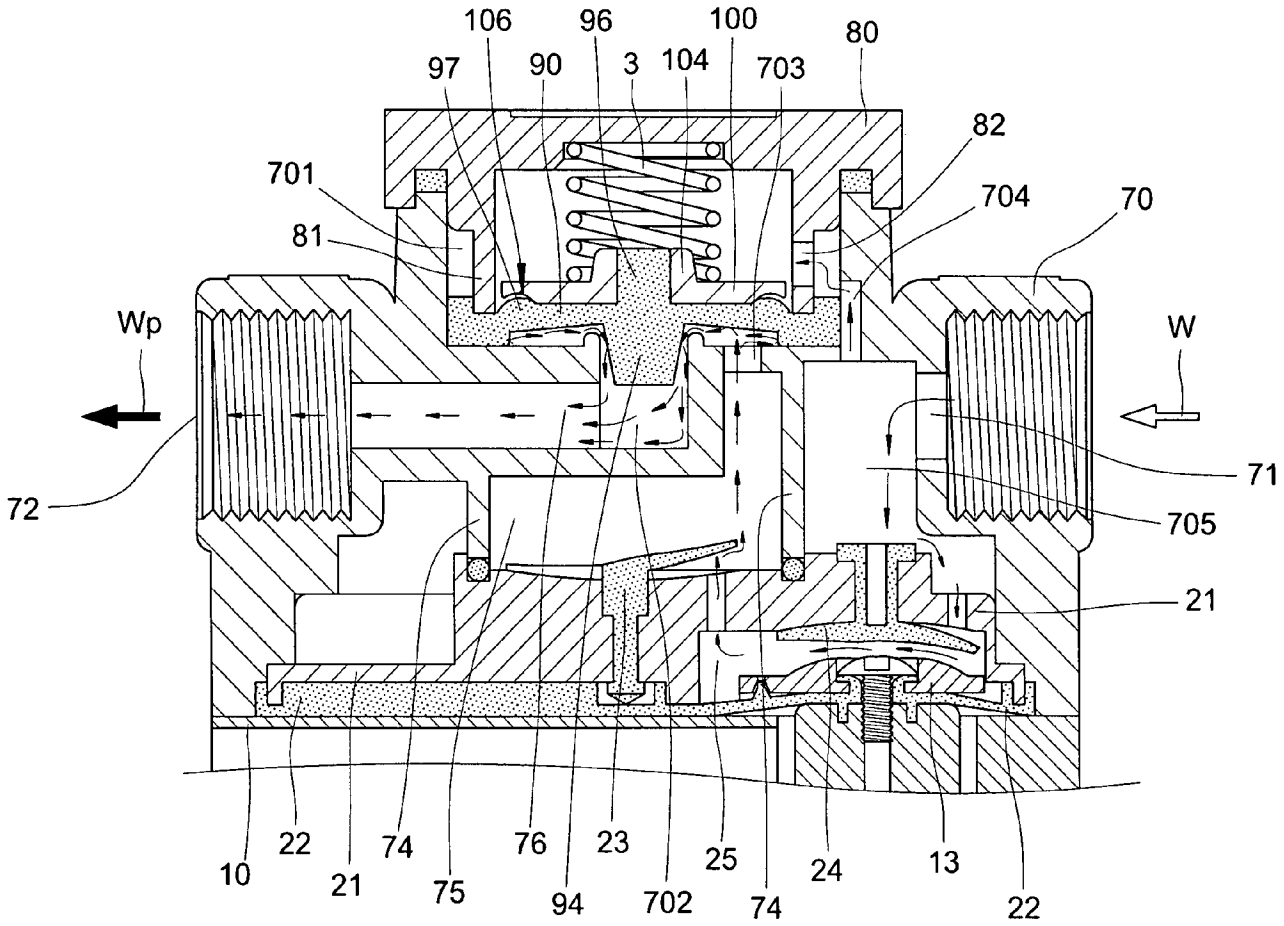
FIG. 25 is an operational view for the third preferred embodiment of the present invention.

Referring to FIGS. 21 through 25, they show a modified obstructing baffle and elastic membrane disk in the third exemplary embodiment of the present invention. Wherein, the modified elastic membrane disk 90 is further disposed a concentric bulged ring 97 inside of the raised rim 95 on the top surface 91 thereof (as shown in FIGS. 23 and 24) while the obstructing baffle 100 is also adapted to create a concentric dented ring 106 inside of the outer peripheral 103 thereof to engage with the corresponding bulged ring 97 (as shown in FIGS. 21 and 22). By reinforced engagement between the bulged ring 97 and the corresponding dented ring 106, the docking manner between the elastic membrane disk 90 and the obstructing baffle 100 can be enhanced without any shifting and rocking movement when the pressurized water Wp upwardly rushes against the elastic membrane disk 90 and obstructing baffle 100. Thus, not only the strength to sustain the stress of the elastic membrane disk 90 can be improved but also the service life for the integral of the elastic membrane disk 90 and obstructing baffle 100 can be prolonged (as shown in FIG. 25).

Figure 26:
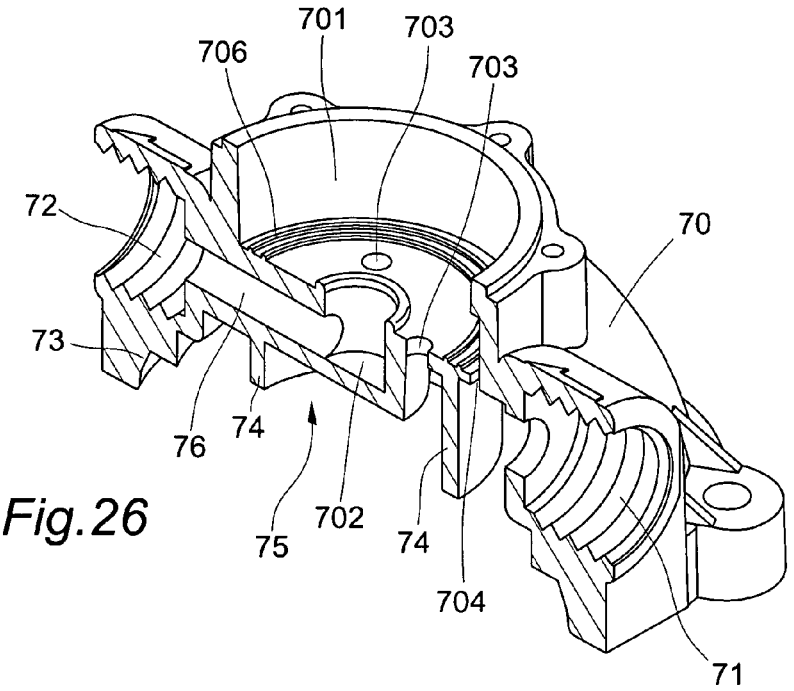
FIG. 26 is a sectional perspective view for a pump cover body in the fourth preferred embodiment of the present invention.
Figure 27:
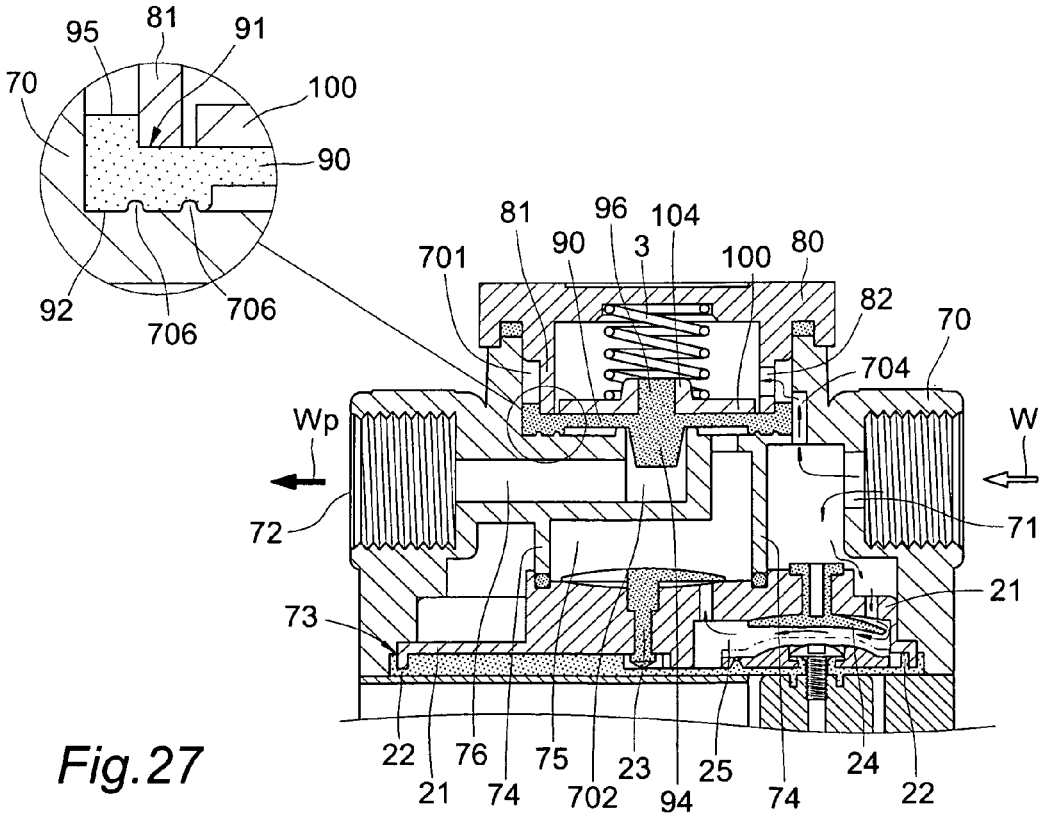
FIG. 27 is an assembly sectional view for a pump cover body in the fourth exemplary embodiment of the present invention.
Figure 28:
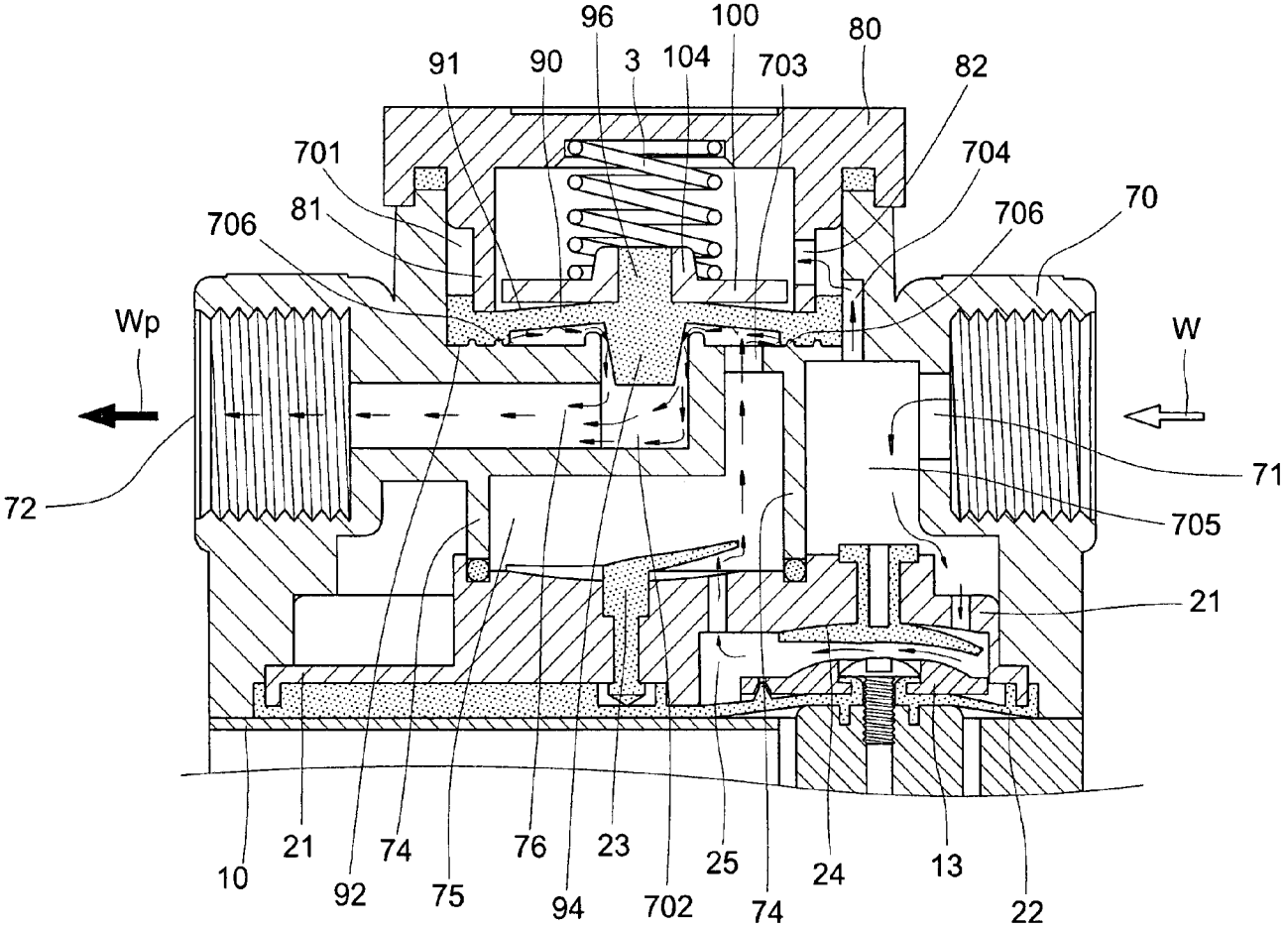
FIG. 28 is an operational view for a pump cover body in the fourth preferred embodiment of the present invention.

Referring to FIGS. 26 through 28, they show a modified pump cover body in the fourth exemplary embodiment of the present invention. Wherein, the modified pump cover body 70 is further disposed a plurality of concentric anti-leakage rims 706 at the internal bottom of the containing pit 701 therein (as shown in FIG. 26 and indicated by enlarged views shown in FIG. 27). By means of the anti-leakage rims 706, the close attachment of the sole surface 92 at the elastic membrane disk 90 against the internal bottom of the containing pit 701 is improved when the terminal rim for the annular well wall 81 of the hood cover mount 80 presses against the top surface 91 of the elastic membrane disk 90. Thus, not only the anti-leakage capability for the integral of the elastic membrane disk 90 and containing pit 701 can be improved but also all the pressurized water Wp from the perforated bore 703 can be ensured to flow into the flow directing compartment 702 (as shown in FIG. 28).

Figure 29:
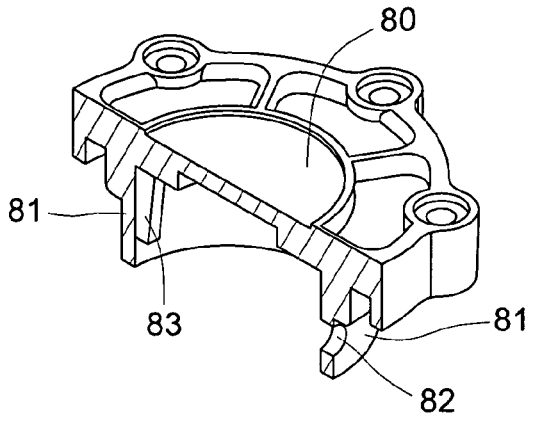
FIG. 29 is a sectional perspective view for a hood cover mount in the fifth preferred embodiment of the present invention.
Figure 30:
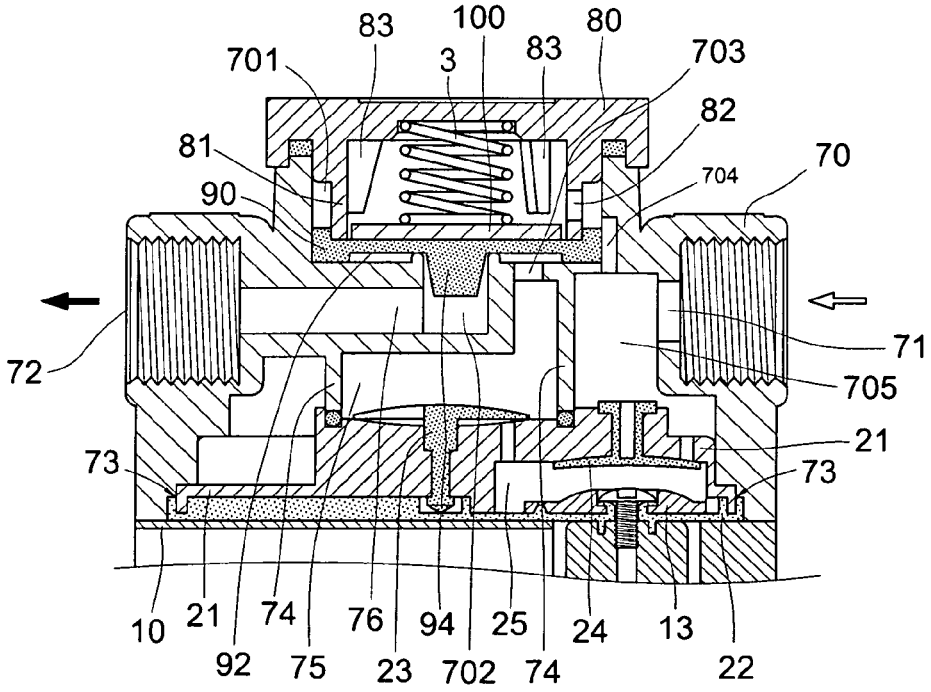
FIG. 30 is a sectional view for a hood cover mount in the fifth preferred embodiment of the present invention.

Referring to FIGS. 29 and 30, they show an adapted hood cover mount in the fifth exemplary embodiment of the present invention. Wherein, the adapted hood cover mount 80 is further disposed a pair of opposed displacement limiters 83 inside the annular well wall 81 thereof (as shown in FIG. 29). By means of the displacement limiters 83, the vertical movement of the obstructing baffle 100 is confined in a suitable range to avoid overreaching the displacement limit of the elastic membrane disk 90 rushed by the pressurized water Wp with loss of resilience in consequence of damage in the elastic membrane disk 90 (as shown in FIG. 30).

Other than the disclosure heretofore, the present invention, which has been tested in practical use by the applicant, is proved that it can definitely eliminate the vibration of the pump cover body with annoying noise created by the impacting momentum of the high pressurized water, which happened in the pump cover body of the conventional water shut-off diaphragm pump. Besides, the solution adopted by the present invention is very simple, which can be easily applied in industrial mass production with economical effect. Thus, the present invention indeed meets the essential criterion of the patentability.

What is claimed is:

1. A vibration reducing device for pump cover body of water shut-off diaphragm pump comprises a pump cover body, a hood cover mount, a plastic elastic membrane disk, an obstructing baffle and a compressed spring, wherein:

said pump cover body, which is a hollow body with a downward opening and an internal tiered rim encompassing a nested annular well wall, includes a containing pit outwardly configured on the top thereof, an inlet port, an outlet port respectively disposed in the peripheral thereof as well as an intensively high-pressured water chamber is created between the internal wall of the annular well wall and top surface of an upper valvular cover; wherein, a central vertical top opening flow directing compartment with a horizontal outlet passage connecting with the outlet port, a plurality of vertical perforated bores and a water passage with a leading space are created at the lower section of said containing pit so that the high-pressured water chamber and containing pit are communicable while the inlet port, the leading space and containing pit are communicable because the perforated bores surrounds the flow directing compartment with a separating cylinder interposed between them while the water passage externally leads the perforated bores with a separating cylinder interposed between them;

said hood cover mount, which is inset in the containing pit of the pump cover body, has a closed top and a downward annular well wall with a plurality of radial flow directing bores disposed on the lower section;

said plastic elastic membrane disk, which attaches on the upper opening of the flow directing compartment in the pump cover body, includes a top surface, a sole surface, an outer peripheral, a downward central flow directing buffer and a marginal raised rim abutting the joint of the top surface and outer peripheral;

said obstructing baffle, which is a planiform plastic disk to be attached on the top surface of the elastic membrane disk, includes a top surface, a sole surface and an outer peripheral jointing the top surface and sole surface as an integral, wherein the outer diameter of the obstructing baffle is slightly smaller than inner diameter of the annular well wall so that the obstructing baffle is inset into the annular well wall of the hood cover mount; and said compressed spring has one end thereof attached against the top surface of the obstructing baffle and the other end thereof attached against the bottom rim for the annular well wall of the hood cover mount.

2. The vibration reducing device for pump cover body of water shut-off diaphragm pump as claimed in claim 1, wherein the shape of the flow directing buffer on the elastic membrane disk is a cylinder, cone or inverted cone.

3. The vibration reducing device for pump cover body of water shut-off diaphragm pump as claimed in claim 1, wherein said elastic membrane disk is further modified to dispose a central orienting shaft on the top surface thereof while said obstructing baffle is also adapted to create an additional corresponding central oriented base with an oriented hole therein.

4. The vibration reducing device for pump cover body of water shut-off diaphragm pump as claimed in claim 1, wherein said elastic membrane disk is further modified to dispose a concentric bulged ring inside of the raised rim on the top surface thereof while the obstructing baffle is also adapted to create a corresponding concentric dented ring inside of the outer peripheral thereof.

5. The vibration reducing device for pump cover body of water shut-off diaphragm pump as claimed in claim 1, wherein said hood cover mount is further adapted to dispose a pair of opposed displacement limiters inside the annular well wall thereof.

6. The vibration reducing device for pump cover body of water shut-off diaphragm pump as claimed in claim 1, wherein said pump cover body is further modified to dispose a plurality of concentric anti-leakage rims at the internal bottom of the containing pit therein.

* * * * *